US008029614B2

(12) United States Patent
Zenpo et al.

(10) Patent No.: US 8,029,614 B2
(45) Date of Patent: Oct. 4, 2011

(54) DRY MIXTURE OF AN AGGREGATE MATERIAL, A MOLDING PROCESS USING THE SAME, AND A CORE MOLD

(75) Inventors: Toshihiko Zenpo, Toyokawa (JP); Yusuke Kato, Toyokawa (JP); Norihiro Asano, Toyokawa (JP); Masahiko Nagasaka, Toyokawa (JP); Kazuyuki Nishikawa, Toyokawa (JP)

(73) Assignee: Sintokogio, Ltd., Aichi-Ken (JP)

( * ) Notice: Subject to any disclaimer, the term of this patent is extended or adjusted under 35 U.S.C. 154(b) by 212 days.

(21) Appl. No.: 12/585,074

(22) Filed: Sep. 2, 2009

(65) Prior Publication Data

US 2010/0064935 A1 Mar. 18, 2010

Related U.S. Application Data

(62) Division of application No. 10/534,032, filed as application No. PCT/JP03/03431 on Mar. 20, 2003, now abandoned.

(30) Foreign Application Priority Data

Nov. 8, 2002 (JP) ..... 2002-324883

(51) Int. Cl.

| | |
|---|---|
| ***B28B 7/36*** | (2006.01) |
| ***C04B 35/66*** | (2006.01) |
| ***B22C 9/00*** | (2006.01) |
| ***B22C 1/02*** | (2006.01) |
| ***B22C 1/16*** | (2006.01) |
| ***B22C 1/22*** | (2006.01) |

(52) U.S. Cl. ..... 106/38.2; 164/15; 164/522; 164/525; 164/526; 164/527; 164/528

(58) Field of Classification Search ..... 106/38.2; 164/15, 522, 525, 526, 527, 528
See application file for complete search history.

(56) References Cited

U.S. PATENT DOCUMENTS

| | | | |
|---|---|---|---|
| 4,495,980 | A | 1/1985 | Morley |
| 4,509,983 | A | 4/1985 | Szabo et al. |
| 5,169,880 | A | 12/1992 | Yoshida et al. |
| 5,215,143 | A | 6/1993 | Gentry |

FOREIGN PATENT DOCUMENTS

| | | | |
|---|---|---|---|
| JP | 53-57122 | A | 5/1978 |
| JP | 53-71626 | A | 6/1978 |
| JP | 53-71627 | A | 6/1978 |
| JP | 55-008328 | A | 1/1980 |

(Continued)

*Primary Examiner* — Anthony Green
*Assistant Examiner* — Pegah Parvini
(74) *Attorney, Agent, or Firm* — Finnegan, Henderson, Farabow, Garrett & Dunner, L.L.P.

(57) ABSTRACT

There are provided a dry aggregate mixture wherein the binder, even when heated, does not evolve unpleasant odor or gas hazardous to human health; a method of foundry molding wherein a space for foundry molding, up to minute portion thereof, can satisfactorily be filled with an aggregate mixture composed of a binder and granular aggregate; and a method of foundry molding wherein the mold used in molding of an aggregate mixture composed of a binder and granular aggregate can retain satisfactory properties even in high humidity. In the method of foundry molding, a mold is formed by the use of a dry mixture obtained by providing an aggregate mixture composed of granular aggregate, a water soluble binder and water and evaporating the water contained in the aggregate mixture through heating, pressure reduction or aeration while mixing so as to effect separation into single granules, or with the addition of a lubricant and a crosslinking agent thereto.

12 Claims, 2 Drawing Sheets

FOREIGN PATENT DOCUMENTS

| | | | |
|---|---|---|---|
| JP | 55-048452 | A | 4/1980 |
| JP | 55-084249 | A | 6/1980 |
| JP | 58-090346 | A | 5/1983 |
| JP | 58-176049 | A | 10/1983 |
| JP | 10-193033 | | 7/1998 |
| JP | 10-230339 | A | 9/1998 |
| WO | WO 00/05010 | | 2/2000 |

DRY MIXTURE OF AN AGGREGATE MATERIAL, A MOLDING PROCESS USING THE SAME, AND A CORE MOLD

RELATED APPLICATIONS

This application is a divisional of U.S. application Ser. No. 10/534,032 filed May 6, 2005 now abandoned which is a §371 of PCT/JP2003/003431 filed Mar. 20, 2003 which claims priority of Japanese patent Application No. 2002-324883 filed Nov. 8, 2002, the contents of all of which are incorporated herein by reference.

FIELD OF THE INVENTION

This invention relates to a dry mixture of an aggregate material containing a binder for a molding process. The dry mixture is capable of eliminating the generation of undesirable gas that is attributed to the heated binder and results in an unpleasant odor and a biohazard for humans in a process for molding a mold (e.g., a core mold), or in the following process to pour molten metal into the resultant core mold. This invention also relates to a molding process using the inventive dry mixture, and a core mold produced by the inventive molding process.

BACKGROUND OF THE INVENTION

Conventional binders to bind sand grains to each other include many inorganic based or organic based binders. Typically, a mold that is composed of solidified sand grains with such a binder is used as a core mold. Such a core mold is disposed in a casting cavity to cast an article such that the core mold forms a contoured surface that is contoured to the inner surface of the cast article. One example of the conventional binders is a phenol-formaldehyde resin.

As one conventional molding process, a shell mold process is known as disclosed in Japanese Patent Early-Publication No. 10-193033. The shell mold process is to use molding sand that is coated with the binder, and to charge it into a heated metal mold using a blowing introducing process. The coating binder of the charged molding sand is then cured by the heat transferred from the mold.

Another conventional molding process uses a water-soluble binder as disclosed in Japanese Patent Early-Publication No. 55-8328. This process is to freeze a mixture comprising the water-soluble binder, water, and molding sand, while the mixture is kneaded.

The frozen mixture is charged into a pre-heated mold using a blowing introducing process. The charged mixture is then dried and thus cured.

The forgoing process disclosed in Japanese Patent Early-Publication No. 10-193033 involves the binder generating volatile gases, such as a formaldehyde gas, a phenol gas, and an ammonium gas, while the binder is thermally cured by the heat transferred from the metal mold. The volatile gases involve unpleasant odors or impose biohazards for a human.

A core mold to be assembled to form a mold often contains a binder that is based on a urea-phenol-formaldehyde resin or a phenol-formaldehyde resin. Pouring a molten metal of an iron alloy or a light-metal alloy into such an assembled mold heats the binder, and in turn it is volatized or decomposed to generate gas, which may cause voids to form within the poured molten metal.

The typical use of the core mold with a resin-binder for casting a non-iron alloy, e.g., an aluminum alloy, resulted in the resin-binder being insufficiently volatized or decomposed, since the temperature of the molten metal to be poured into the mold is about 700° C. This may prevent the core mold from being readily removed from the cooled and solidified molten metal. The insufficiently removed core mold needs to be shaken, or to be re-heated so that the solidified molten metal in turn volatizes or decomposes the binder, in order to remove it.

The forgoing molding process disclosed in Japanese Patent Early-Publication No. 55-8328 is to freeze the mixture of the water-soluble binder, the water, and the molding sand, as noted above. This results in silica sand grains within a blow-head being concentrated to be formed as rocks or clots when the frozen mixture is charged into the metal mold. This effect is also possible in the interval between two adjacent cycles of charging. This effect involves the difficulty in continuously charging the mixture from the blow-head into the mold. Indeed, such a molding process has not yet been practiced.

When the core mold with the water-soluble binder is deposed in a high-humidity environment, the water-soluble binder typically absorbs water and thus its binding force is weakened, to cause the deformation of the core mold. As a result, the core mold may not maintain its shape. Even such a core mold can be used in the molding process, and the moisture within it is heated and vaporized when the molten metal is poured into the core mold. The resulting vapors form voids within the poured molten metal.

THE DISCLOSURES OF THE INVENTION

The present invention provides a dry mixture of an aggregate material and a molding process for molding a mold that is capable of removing the forgoing problems.

A first object of the present invention is to provide a dry mixture of an aggregate material that is capable of generating no gas that has an unpleasant odor or a biohazard for humans when a binder is heated.

A second object of the present invention is to provide a molding process that is capable of sufficiently and accurately charging a mixture of aggregate material that contains a binder and the sand into a molding space.

A third object of the present invention is to provide a molding process in which a core mold that is molded in a mixture of an aggregate material that contains the sand and a binder is capable of maintaining its shape even if it is in a high-humidity environment.

A fourth object of the present invention is to provide a core mold for molding an aluminum alloy. Such a core mold is capable of being readily removed from the cooled molten metal and molding a favorable cast article. This core mold for molding the aluminum alloy is molded with the molding process of the present invention.

The fifth object of the present invention is to provide a core mold for molding a metal that is an iron-alloy, or a copper-alloy, etc., having a higher temperature in its molten state than that of the aluminum alloy to be poured into a mold. Such a core mold is molded with the molding process of the present invention, but a mold wash is applied on the surface of it.

The present invention also relates to a dry mixture of an aggregate material prepared by the steps of:

mixing an aggregate granular material, one or more kind of a water-soluble binder, and water, to make a mixture;

evaporating the moisture within the mixture during the mixing step such that the mixture is dried and has single-grain structures; and wherein additional water is to be added to the dry mixture to form a molding material for molding a mold with the dry mixture.

Another embodiment of the present invention relates to a dry mixture of an aggregate material prepared by the steps of:

mixing an aggregate granular material, a water-soluble binder, a cross-linker that is capable of cross-linking with the water-soluble binder, and water;

evaporating the moisture within the mixture during the mixing step to prevent the cross-linking reaction between the water-soluble binder and the cross-linker, so that the mixture is dried and has single-grain structures; and wherein additional water is to be added to the dry mixture to form a molding material for molding a mold with the dry mixture.

In the forgoing mixtures, the aggregate granular material is coated with the water-soluble binder.

In one embodiment of the present invention the dry mixture further includes a lubricant.

The present invention also relates to a molding process for molding a mold. The process comprises the steps of:

freezing one of the above dry mixtures with the additional water but without a lubricant such that the mixture has single-grain structures;

charging the frozen mixture into a molding space, and evaporating the moisture within the charged mixture to cure the charged mixture to mold a mold with the cured mixture; and removing the molded mold from the molding space.

The present invention also relates to a molding process for molding a mold. The process comprises the steps of:

freezing one of the above mixtures with the additional water such that the mixture has single-grain structures;

temporarily storing in a vessel a quantity of the frozen mixture that is greater than or equal to the quantity of the frozen mixture to be charged into a molding space;

stirring the mixture within the vessel in a condition in which the frozen moisture within the mixture cannot be thawed, to maintain the single-grain structures of the mixture; and charging the stirred mixture into the molding space.

If a mixture that contains no lubricant is frozen, a lubricant is then preferably added thereto. This is more effective than using a mixture that already contains a lubricant.

Another embodiment of the present invention relates to a molding process for molding a mold. The process comprises the steps of:

stirring one of the mixtures with the additional water, but including neither a lubricant nor a cross-linker to cause it to foam;

charging the foamed mixture into a molding space;

evaporating the moisture within said charged mixture to cure said charged mixture to mold a mold with said cured mixture; and removing said molded mold from said molding space.

The present invention also relates to a molding process for molding a mold. The process comprises the steps of:

freezing one of the mixtures containing a cross-linker and the additional water such that the mixture has single-grain structures;

charging the frozen mixture with the lubricant into a molding space;

evaporating the moisture within the charged mixture to cure the charged mixture to mold a mold with the cured mixture;

causing a cross-linking reaction between the water-soluble binder and the cross-linker; and removing the molded mold from the molding space.

In this molding process, the present invention may comprise the steps of:

freezing the mixture such that the mixture has single-grain structures;

temporarily storing in a vessel a quantity of the frozen mixture that is greater than or equal to the quantity of the frozen mixture to be charged into a molding space;

stirring the mixture within the vessel in a condition in which the frozen moisture within the mixture cannot be thawed, to maintain the single-grain structures of the mixture; and charging the stirred mixture into the molding space.

The present invention also relates to a molding process for molding a mold. The process comprises the steps of:

freezing one of the mixtures containing a cross-linker and additional water such that the mixture has single-grain structures;

charging said frozen mixture into a molding space;

heating or aerating and thus evaporating the moisture within the charged mixture in the molding space to cure the charged mixture to mold a mold with the cured mixture;

removing said molded mold from the molding space; and further facilitating a cross-linking reaction between the water-soluble binder and the cross-linker in the removed mold.

This molding process may comprise the steps of:

freezing and solidifying the mixture such that the mixture has single-grain structures;

temporarily storing in a vessel a quantity of the frozen mixture that is greater than or equal to the quantity of the frozen mixture to be charged into a molding space;

stirring the mixture within the vessel in a condition in which the frozen moisture within the mixture cannot be thawed, to maintain the single-grain structures of the mixture; and charging the stirred mixture into the molding space.

The molding process may comprise the steps of:

temporarily storing in a vessel a quantity of the frozen mixture that is greater than or equal to the quantity of the frozen mixture to be charged into a molding space;

stirring the mixture within the vessel in a condition in which the frozen moisture within the mixture cannot be thawed, to maintain the single-grain structures of the mixture; and charging the stirred mixture into the molding space.

Another embodiment of the present invention relates to a molding process for molding a mold. The process comprises the steps of:

stirring one of the above mixtures containing the lubricant and the additional water to cause it to foam;

charging the foamed mixture into a molding space;

evaporating the moisture within the charged mixture in the molding space;

causing a cross-linking reaction between the water-soluble binder and the cross-linker; and removing the molded mold from the molding space.

Another embodiment of the present invention relates to a molding process for molding a mold. The process comprises the steps of:

stirring one of the above mixtures containing the lubricant and the additional water to cause it to foam;

charging the foamed mixture into a molding space;

evaporating the moisture within the charged mixture in the molding space;

removing the molded mold from the molding space; and further facilitating a cross-linking reaction between the water-soluble binder and the cross-linker.

The present invention also relates to a core mold for molding an aluminum alloy. The core mold is molded by the molding process described immediately above.

In the present invention, the aggregate granules consist of one or more of silica, aluminum sand, olivine sand, chromite sand, zircon sand, mullite sand, and so forth.

The molding process of the present invention can be readily carried out by a means for removing the core mold that is molded in the dry aggregate material with the water-soluble binder of the present invention. This is because the water-soluble binder can be readily volatilized or made soluble when molten metal is poured into the core mold.

The water-soluble binder is desirably capable of being made soluble by the water at the ambient temperature. If the aggregate granular material is coated with such a desirable water-soluble binder, the binder can be mixed with the water without heating. In contrast, a water-soluble binder having no capability of being made soluble by the water at the ambient temperature cannot act as a binder without heating, since it needs heating to mix with the water. The energy and time required for heating the mixture takes increased consumption of it to freeze and solidify the mixture so that the mixture has single-grain structures.

Preferably the water-soluble binder is at least either a polyvinyl alcohol or its derivative, or at least either a starch or its derivative, or both. An example of the polyvinyl alcohol derivative contains such as an acetic acid radical, a carboxyl group, a butyrate group, or a silanol group, etc. An example of the starch is derived from a potato, corn, tapioca, or wheat, etc. An example of the starch derivative is an etherified starch, an esterified starch, or a cross-linking starch. Neither thermoplastic starch nor graft starch is suitable for the present invention, since their strength is insufficient to use as a binder.

The water-soluble binder that is employed in the present invention is readily available. Especially, the starch is commercially available at a low cost.

Preferably, the mixture contains from 0.1 wt % to 5.0 wt % of the water-soluble binder based on the total weight (i.e., 100 wt %) of the aggregate granular material. Less than 0.1 wt % of the water-soluble binder causes a mold having insufficient strength. More than 5.0 wt % of the water-soluble binder causes it to form larger clots during the process of maintaining the single-grain structures in the frozen mixture such that effort and time is required for sufficiently carrying out such a process. Further, the molded mold has excessive strength.

A predetermined amount of water is preferably added to the wet mixture containing no cross-linker such that the sum of the moisture within the water-soluble binder and the additional water contains practically about 5 wt % to 30 wt % of the total weight of the aggregate granular material. A predetermined amount of water is preferably added to the wet mixture containing a cross-linker such that the sum of the moistures within the water-soluble binder and the cross-linker solution contains about 5 wt % to 30 wt % of the total weight of the aggregate granular material. A mixture with a low water content causes a difficulty in that the aggregate material is uniformly coated with the binder. A mixture with a high water content takes time to dry it.

Evaporating the moisture within the wet mixture to make the dry mixture is possible through the use of a heating process, a decompression process, or an air curing process.

One way to heat the wet mixture to evaporate the moisture uses a sand mixer to stir the aggregated granular material, the water-soluble binder solution, and the water, while heated air having a temperature of about 100° C. from a hot-air heater is applied to the stirred mixture for about 10 minutes.

One way to decompress the wet mixture to evaporate the moisture is to apply a pressure of 0.01 MPa to the wet mixture in temperature-controlled bath that is maintained at a temperature of 25° C.

To air cure the wet mixture, heated and compressed air may be used.

The aggregate granules of the dry mixture of the present invention are coated with the water-soluble binder.

The final water content within the dry mixture of the present invention is preferably less than about 1.0 wt % based on the total weight of the mixture.

The lubricant used in the present invention prevents the grains within a blow-head from being concentrated during the intervals between the preceding and following blowing introducing cycles. Therefore, substantial continuous blowing can be achieved to ensure that a stable and high-density mixture is charged in the molding space.

Examples of the lubricant that may be used in the present invention include a non-waxed paraffin such as a liquid paraffin; and salts of stearic acid such as a calcium stearate, a zinc stearate, or a magnesium stearate. The lubricant is added to the mixture before or after the mixture is frozen, to readily construct and maintain the single-grain structures of the mixture. To develop better effectiveness for the lubricant, it is preferably added to the mixture after the mixture is frozen.

If the lubricant is calcium stearate, the mixture contains from about 0.01 wt % to 0.1 wt % of it based on the total weight of the aggregate granular material.

In the above method in which the dry mixture contains the cross-linker to cause the cross-linkage reaction between the cross-linker and the water-soluble binder, the cross-linker is heated to cause the cross-linkage reaction, to enhance the bond strength of the aggregate grains by the water-soluble binder. This prevents the reaction between the water-soluble binder and the water molecules and thus the mold that is molded in the dry mixture can readily maintain its characteristics even in a high-humidity environment.

During the step of heating the wet mixture in order to evaporate the moisture within it to make a dry mixture, if the water-soluble binder and the cross-linker are heated higher than the threshold temperature that causes the rapid cross-linkage reaction therebetween, an undesirable cross-linkage reaction is caused. In this case, the molded mold is ineffective in the cross-linkage, since no cross-linkage reaction occurs in the following steps. Thus, the water-soluble binder and the cross-linker should not be heated higher than the threshold temperature.

If the cross-linker is a butane-tetracarboxylic acid, it should be heated to below its melting point, i.e., 180° C. As nonlimiting examples, the cross-linker used in the present invention is an aldehyde such as a glyoxal; an N-methylol compound such as an N-methylol urea, or an N-methylol melamine; a carboxylic compound such as an oxalic acid, a maleic acid, a succinic acid, a butane-tetracarboxylic acid, or a methyl vinyl ether-maleic acid copolymer; an epoxy compound; an activated vinyl compound; an diisocyanate; a complexing agent, and so forth.

One example of the epoxy compound is an epichlorohydrin.

Examples of the diisocyanate are a hexamethylene diisocyanate, a diphenylmethane-4, and a 4-trilene diisocyanate.

Examples of the complexing agent include Cu, B, Al, Ti, Zr, Sn, V, or Cr. Because the complexing agent involves an accumulated metal in the aggregate material, it is not suitable for the aggregate material grains that are recycled and used.

One desirable cross-linker may act as an ester linkage, i.e., a compared carboxylic, since it lowers the generation of poison gas during the molding process and the pouring process.

The amount of the cross-linker to be added is from 5 wt % to 50 wt % based on the total weight of the water-soluble binder. If there is less than 5 wt % of the cross-linker to the total weight of the water-soluble binder, the effectiveness of the cross-linkage reaction would be insufficient and thus the mold could not maintain its required strength in a high-humidity environment. Using more than 50 wt % of the cross-linker to the total weight of the water-soluble binder just produces a strength that is substantially equal to that using just 50 wt % of the cross-linker to the total weight of the water-soluble binder, although the mold has a significant strength even in the high-humidity environment. Therefore, adding more than 50 wt % of the cross-linker is costly and thus undesirable.

The cross-linker is used as a cross-linker solution. For example, about 20 wt % of a butane-tetracarboxylic acid solution, or a methyl vinyl ether-maleic acid copolymer solution, may be used.

In the molding process of the present invention, the dry mixture contains from 0.5 wt % to 10.0 wt % of the water based on the total weight (i.e., 100 wt %) of the dry mixture. The additional water within the mixture is distributed in the water-soluble binder and evaporated during the molding step. The resultant binder then solidifies the aggregate grains. Less than 0.5 wt % of the water increases the viscosity of the water-soluble binder too much, so as to lower the bond strength of the binder to bond the aggregate grains. In this case, the resultant mold has an insufficient strength. More than 10.0 wt % of the additional water causes voids within the mold due to the water being evaporated during the molding step, and thus decreasing the strength of the mold. Further, since excessive water takes the energy and time required for heating the mixture, it is costly and thus undesirable.

The cross-linking reaction may be carried out after or before the molded mold is removed from the molding space. If it occurs before the molded mold is removed from the molding space, the cycle of the molding process is lengthened. If such a lengthened cycle involves a production problem, the cross-linking reaction may be reacted after the molded mold is removed from the molding space.

The reaction interval of the cross-linking reaction after the molded mold is removed from the molding space is, for example, about 40 minutes at an ambient temperature of 220° C., or about 20 minutes at an ambient temperature of 250° C., or a shorter time at a higher ambient temperature.

In the molding process of the present invention, the dry mixture with the additional water is frozen such that the mixture has single-grain structures. The resultant mixture can be sufficiently and accurately charged into the molding space.

The term "single-grain structures" refers to the state in which discrete grains of the aggregate material, or clots of concentrated grains of the aggregate material, are uniformly distributed in the molding space, with sizes whereby they can be sufficiently and accurately charged into the molding space.

In the molding process of the present invention, the dry mixture with the additional water is frozen, to construct in the mixture the single-grain structures in which the surfaces of the aggregate grains are coated with the frozen binder solution. The frozen binder solution is a water solution in which the coated binder of the surfaces of the aggregate grains is dissolved in the water.

To maintain the single-grain structures of the frozen mixture, stirring the mixture with a stirring device having stirring blades in a condition wherein temperatures lower than 0° C., or stirring the mixture by a compressed gas such as air with low temperatures such as from −20° C. to 30° C. or a lower temperature, is necessary. If the blowing molding process is employed, by maintaining the single-grain structures, the following blowing introducing can be readily carried out.

In one aspect of the molding process of the present invention, a mixture with additional water is stirred to cause it to foam, and the foamed mixture is charged into the molding space. The mixture is stirred to distribute the foamed air therein. This causes the mixture to be desirably fluidized when it is charged into the molding space under increased pressure, and thus no lubricant is needed. In this molding process, the foams that are distributed within the mixture by the stirring and the moisture within the binder are concentrated at the center portion of the mold by the heat transferred from a metal mold. Therefore, the center portion of the mold has a low density of the charged mixture and thus the amount of the binder is reduced in the center portion. Consequently, gas due to the decomposed binder can be reduced and readily exhausted, through the porosity of the mold.

The stirring to cause the mixture to foam may be carried out by means of the stirring device to uniformly distribute the resulting foam in the mixture. A sufficient time required for stirring the mixture is just about one minute.

The core mold for casting the present invention is molded with the molding process of the present invention. When the core mold of the present invention is used for casting a non-ferrous alloy such as an aluminum alloy, a molten metal of it having a temperature of about 700° C., which is lower than the about 1,400° C. of that of a ferrous material, is poured into the mold such that the water-soluble binder in the present invention can be volatilized or dissolved by the temperature of about 700° C. The core mold then can be readily removed from the cast article after the molten metal cools. A mold wash is applied on the surface of the core mold of the present invention in order to be well adapted to cast the ferrous material in which the mold can be readily removed. Examples of the mold wash are an ethanol-based mold wash, a water-based mold wash, and so forth.

Methods of charging the mixture of the present invention into the molding space include blowing, an increase in pressure, a suctioning by decreasing the pressure in the molding space, and so forth.

The methods for evaporating the moisture within the charged mixture in the molding space include a heat transfer from a heated metal mold is defining the molding space, an exposure of the mixture to heated vapors or microwaves, and a vacuum environment in which the mixture is placed. The methods also include an air cure for the molding space, if needed.

PREFERRED EMBODIMENTS OF THE INVENTION

Below the dry mixtures of aggregate materials and molding processes for molding molds of the present invention are described in detail.

The First Preparation (1) of a Dry Mixture of an Aggregate Material

To form a mixture, 100 wt % of an aggregate granular material; a water-soluble binder solution from 0.1 to 5.0 wt % based on the total weight of the aggregate granular material; and a predetermined amount of water, are mixed. The predetermined amount of the additional water is determined such that the total amount of the additional water and the water component in the water-soluble binder solution are from 5 to 30 wt % based on the total weight of the aggregate granular material. The moisture within the mixture is then evaporated and removed by applying a hot-air drying on the mixture. This results in a dry mixture in which the surfaces of the aggregate granular material are coated with the water-soluble binder.

The Second Preparation (2) of a Dry Mixture of an Aggregate Material

To form a mixture, 100 wt % of an aggregate granular material; a water-soluble binder solution from 0.1 to 5.0 wt % based on the total weight of the aggregate granular material; about 20 wt % of a cross-linker solution (that contains a cross-linker from 5 to 50 wt % based on the total weight of the water soluble binder) based on the total weight of the aggregate granular material; and a predetermined amount of water, are mixed. The predetermined amount of the additional water is determined such that the total amount of the additional water and the water component in the water-soluble binder solution are from 5 to 30 wt % based on the total weight of the aggregate granular material. The moisture within the mixture is then evaporated and removed by applying a hot-air drying on the mixture. In turn, a dry mixture is then prepared. In this dry mixture, the surfaces of the aggregate granules are coated with the water-soluble binder that contains the cross-linker.

The First Molding Process

Figure 1:
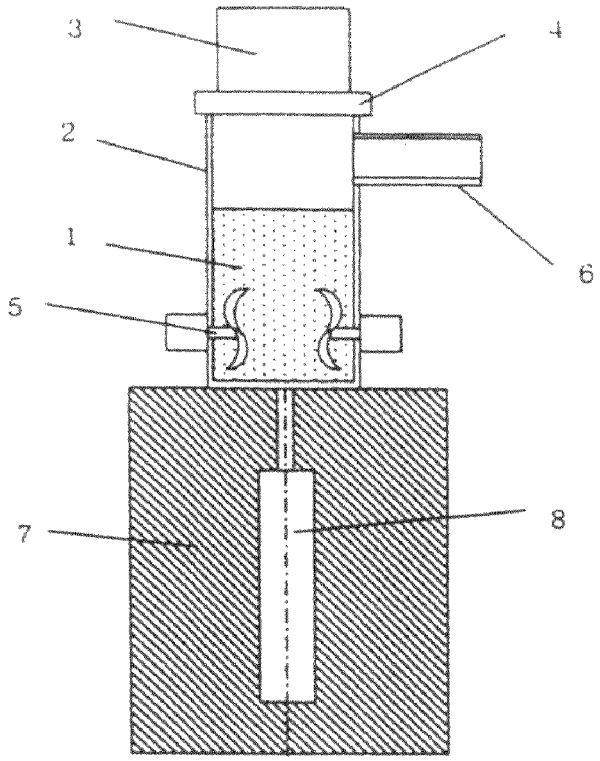
FIG. 1 is a schematic cross-sectional elevational view of a molding machine to embody one molding process of the present invention.

One molding process of the present invention will now be described with reference to FIG. 1. 0.5 to 10.0 wt % of water is added to and mixed with 100 wt % of the dry mixture prepared by the first preparation (1). The dry mixture with the additional water is then mixed by means of a mixer in a temperature-controlled freezer at temperatures from −20 to −30° C. to freeze and harden the mixture such that it has single-grain structures. A quantity of the mixture is temporarily stored in a blowing head 2. This quantity of the mixture is more than the predetermined quantity of the mixture to be charged one time into a cavity 8 of a metal mold 7 for molding a mold. The temporarily stored mixture is then stirred by stirring blades 5 to maintain the single-grain structures in the mixture under a condition in which the frozen moisture within the mixture cannot be thawed. A cylinder 3 is then lowered to close the blowing head by a seal 4, which is provided at the distal end of the cylinder 3. The mixture 1 is then charged by blowing it together with compressed air supplied through an air-inlet pipe 6, which is attached to the blowing head, into the cavity 7 of the metal mold 8 beneath the blowing head 2. The metal mold 8 is maintained within temperatures ranging from one that is higher than the temperature at which water is evaporated, but is lower than the temperature at which the water-soluble binder is rapidly decomposed. Such a range of temperatures is preferably from 150 to 250° C. The moisture within the charged mixture is then evaporated to cure the mixture. In turn, the resultant molded mold is thus removed from the cavity 8 of the metal mold 7.

The Second Molding Process 0.5 to 10.0 wt % of water is added to and mixed with 100 wt % of the dry mixture prepared by the second preparation (2). The dry mixture with the additional water is then mixed, while it is frozen by means of a nitro gas having temperatures lower than −30° C. to cure the mixture such that it has single-grained structures. An amount of the mixture is temporarily stored in the blowing head 2. This amount of the mixture is more than the predetermined amount of the mixture to be filled one time within the cavity 8 of the metal mold 7. The temporarily stored mixture is then stirred by the stirring blades 5 to maintain the single-grain structures in the mixture under a condition in which the moisture within the mixture cannot be thawed. The cylinder 3 is then lowered to close the blowing head by the seal 4, which is provided at the distal end of the cylinder 3. The mixture 1 is then charged by blowing compressed air supplied through an air-inlet pipe 6, which is attached to the blowing head, into the cavity 7 of the metal mold 8 beneath the blowing head 2. The metal mold 8 is maintained within temperatures ranging from one that is higher than the temperature at which the water is being evaporated, but is lower than the temperature at which the water-soluble binder is being rapidly decomposed. Such a range of temperatures is preferably from 150 to 250° C. The moisture within the charged mixture is then evaporated to cure the mixture. The resulting molded mold is removed from the cavity 7 of the metal mold 8. The removed mold is then left in a temperature-controlled bath at temperatures ranging from one at which the cross-linkage reaction is sufficiently reacted between the water-soluble binder and the cross-linker, preferably from 200 to 250° C., for a reaction time. This reaction time is a period by which the cross-linkage reaction is sufficiently carried out between the water-soluble binder and the cross-linker, preferably from 20 to 90 minutes. The mold is then removed from the temperature-controlled bath after the cross-linkage reaction is sufficient.

Freezing and curing of the mixture is also possible through use of a cool blast in temperatures from −20 to −30° C. supplied from a refrigerator. The remaining steps are identical to those as above described.

The Third Molding Process

Water of 0.5 to 10.0 wt % is added to and mixed with 100 wt % of the dry mixture prepared by the second preparation (2). The dry mixture with the additional water is then mixed by means of a mixer in a temperature-controlled freezer at the temperatures from −20 to −30° C. to freeze and cure the mixture such that it has single-grained structures. A quantity of the mixture is temporarily stored in a blowing head 2. This quantity of the mixture is more than the predetermined quantity of the mixture that is to be charged one time into a cavity 8 of a metal mold 7 for molding a mold. The temporarily stored mixture is then stirred by stirring blades 5 to maintain the single-grained structures in the mixture in a condition in which the frozen moisture within the mixture cannot be thawed. A cylinder 3 is then lowered to close the blowing head by a seal 4, which is provided at the distal end of the cylinder 3. The mixture 1 is then charged by blowing compressed air supplied through an air-inlet pipe 6, which is attached to the blowing head, into the cavity 7 of the metal mold 8 beneath the blowing head 2. The metal mold 8 is maintained within temperatures ranging from those higher than the temperature at which the water is being evaporated, but is not a temperature at which the water-soluble binder is being rapidly decomposed. Such a temperature range is preferably from 150 to 250° C. The moisture within the charged mixture is then evaporated to cure the mixture. The resultant molded mold is thus removed from the cavity 8 of the metal mold 7.

The Fourth Molding Process

Figure 2:
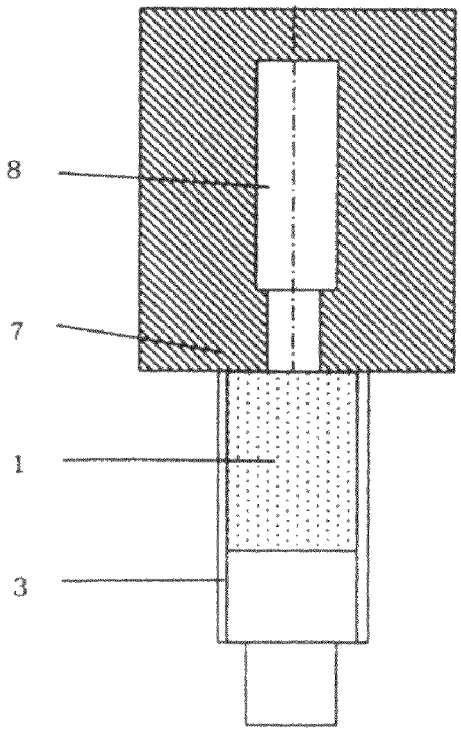
FIG. 2 is a schematic cross-sectional elevational view of a molding machine to embody another molding process of the present invention.

Another molding process of the present invention will be described in line with FIG. 2. Water of 0.5 to 10.0 wt % is added to 100 wt % of the dry mixture prepared by the second preparation (2). The dry mixture with the additional water is then mixed and stirred to cause the mixture to foam. The resultant mixture 1 is then filled in a cylinder 3. The cylinder 3 is then extended to charge the mixture 1 into a cavity 8 of a metal mold 7 above the cylinder 3. The metal mold 7 is maintained within temperatures ranging from those higher than the temperature at which water is being evaporated, but is not a temperature at which the water-soluble binder is being rapidly decomposed. Such a temperature range is preferably from 150 to 250° C. The moisture within the charged mixture is then evaporated to cure the mixture. The resulting molded mold is removed from the cavity 8 of the metal mold 7. The removed mold is then placed in a temperature-controlled bath at a temperature ranging from that at which the cross-linkage reaction between the water-soluble binder and the cross-linker is sufficient, preferably from 200 to 250° C., for a reaction time. This reaction time is a period in which the cross-linkage reaction between the water-soluble binder and the cross-linker is sufficient, preferably from 20 to 90 minutes. The mold is then removed from the temperature-controlled bath after the cross-linkage reaction is sufficient.

The First Embodiment

A dry mixture of an aggregate material is prepared in line with the first preparation (1). This dry mixture comprises the following components:

100 wt % of silica sand (flattery sand); 0.4 wt % of polyvinyl alcohols R-2105 and R-1130 (each of which is a polyvinyl alcohol derivative containing a silanol group; the R-2105 has a low viscosity, while the R-1130 has a high viscosity); and 0.8 wt % of polyvinyl alcohols PVA 105 and PVA 124 (both of which are completely suspended polyvinyl alcohols that are made by Kuraray Co., Ltd, Japan; the PVA 105 has a low viscosity, while the PVA 124 has a high viscosity).

Water of 6 wt % is added to and mixed with 100 wt % of the dry mixture. The dry mixture with the additional water is then mixed by means of a mixer in a temperature-controlled freezer at about −30° C. to freeze and cure the mixture such that it has single-grained structures. In connection with FIG. 1, about 500 grams of the resultant mixture is temporarily stored in the blowing head 2, which is pre-cooled in a temperature-controlled freezer at about −30° C. The temporarily stored mixture is then stirred by the stirring blades 5, which are also pre-cooled at about −30° C., operating at about 600 rpm to maintain the single-grain structures in the mixture. The cylinder 3 is then lowered to close the blowing head by the seal 4, which is provided at the distal end of the cylinder 3. About 100 grams of the mixture 1 are then charged by blowing compressed air supplied through the air-inlet pipe 6, which is attached to the blowing head 2, into the cavity 8, with a volume of about 70 $cm^3$, in the metal mold 7 beneath the blowing head 2. The cavity 8 is maintained at 150° C. by an internal electric-cartridge heater within the metal mold 7. The charged mixture in the cavity 8 is maintained for about 2 minutes such that the moisture within the charged mixture is then evaporated to cure the mixture. The resultant molded mold is removed from the cavity 8 of the metal mold 7.

For an experiment, the resultant molded mold is used as a core mold for casting. A molten metal of an aluminum alloy AC4B having a temperature of 710° C. is poured into the core mold. Although the four kinds of the polyvinyl alcohols (they compose the water-soluble binder) are added in the two groups of the amounts added to the mixture, neither an unpleasant odor nor a cast defect has been found. Because the binder was volatilized or decomposed by the heat of 710° C. of the molten metal that was poured into the core mold, the core mold can be readily removed after the molten metal cools.

The Second Embodiment

A dry mixture of an aggregate material is prepared by the second preparation (2). This dry mixture comprises 100 wt % of silica sand (flattery sand), 0.8 wt % of a polyvinyl alcohol JP-05 (made by Japan VAM & Poval Company), and 0.34 wt % of a butane-tetra-carboxylic acid (Rikashid BT-W, made by New Japan Chemical Company) as a cross-linker. 6 wt % of water is added to and mixed with 100 wt % of the dry mixture. The dry mixture with the additional water is then further mixed, while it is frozen and cured by means of a nitro gas having temperatures lower than −30° C. In connection with FIG. 1, about 500 grams of the resulting mixture are temporarily stored in the blowing head 2, which is pre-cooled by means of a cooled-blast of a nitro gas having a temperature of about −30° C. The temporarily stored mixture is then stirred by the stirring blades 5 operating at about 60 rpm to maintain the single-grained structures in the mixture, under a condition that is subjected to a cooled-blast of a nitro gas having temperatures of about −30° C. The cylinder 3 is then lowered to close the blowing head by the seal 4, which is provided at the distal end of the cylinder 3. About 100 grams of the mixture 1 are then charged by blowing compressed air supplied through the air-inlet pipe 6, which is attached to the blowing head 2, into the cavity 8, with a volume of about 70 $cm^3$, in the metal mold 7 beneath the blowing head 2. The cavity 8 is maintained at 150° C. by the internal electric-cartridge heater within the metal mold 7. The charged mixture in the cavity 8 is maintained for about 2 minutes such that the moisture within the charged mixture is then evaporated to cure the mixture. The resulting molded mold is removed from the cavity 8, which is maintained at a temperature of 150° C., of the metal mold 7. The removed mold is then placed in a temperature-controlled bath that is maintained at a temperature of 200° C. to accelerate the cross-linkage reaction for 80 minutes. The mold is then removed from the temperature-controlled bath. The mold is then placed in a humidity-controlled bath that is maintained at a humidity of 30% to naturally cool the mold at room temperature. For a flexural investigation, specimens are made from the resulting mold. Such a specimen as it is, and a specimen that is placed in a temperature-controlled bath that is maintained at a temperature of 350° C. for 30 minutes from when this specimen is made, are prepared. Their flexural strengths are then measured and thus their strength degradation rates are derived from the measured results. The strength degradation rates may be used as rough standards to determine whether a resultant core mold can be readily removed from a casting article when such a core mold is used to cast a light metal alloy such as an aluminum alloy. Table 1 shows the results of the flexural investigations. In identical conditions of the investigation, one comparative shell, whose binder is a phenol resin, has a strength degradation rate of about 20%, and another comparative shell (AD shell, made by Asahi Organic Chemicals Industry, Japan), whose binder is an acrylic resin, for casting an aluminum alloy, has a strength degradation rate of about 70%. Accordingly, the inventive mold that is molded by the inventive molding process with the inventive binder of the present invention is superior to the compared mold.

TABLE 1

| Components | Flexural strength (Mpa) | | Strength degradation rate |
|---|---|---|---|
| 0.8 wt % of polyvinyl alcohal | Initial | 350° C. for 30 min | 92.6 |
| 0.34 wt % of cross-linker | 3.1 | 0.23 | |

For another investigation, specimens are made from a mold that is made by the casting process of the embodiment.

One specimen is placed in a humidity-controlled bath that is maintained in a humidity of 30%, while another specimen is placed in a humidity-controlled bath that is maintained in a humidity of 98% for 24 hours. Table 2 shows the measured densities of the fillings and the strengths at which these specimens were flexed. From Table 2, it is proven that the inventive mold with the added cross-linker has a sufficient flexural strength to be used as a mold, even if it is placed in a humidity-controlled bath at a humidity of 98% for 24 hours. A comparative specimen without a cross-linker is made from a mold that is molded by a molding process. This process is similar to that for the above inventive specimen, except that this process uses no cross-linker. The comparative specimen has a flexural strength equal to that of the inventive specimen when it is placed in a humidity-controlled bath at the humidity of 30%. However, the flexural strength of the comparative specimen is degraded to lower than 0.5 MPa when the comparative specimen is placed in the humidity-controlled bath at a humidity of 98%. Accordingly, if a mold to be made is to be possibly placed in a condition under high humidity, it is preferable to add a cross-linker to the inventive mixture of the present invention.

TABLE 2

| Water-soluble binder (Polyvinyl alcohol) | | Cross-linker | | Density | Flexural strength (Mpa) | |
|---|---|---|---|---|---|---|
| Type | Additive quantities (wt %) | Type | Additive quantities (wt %) | of fillings (g/cm$^3$) | 30% humidity | 98% humidity for 24 hr |
| JP-05 | 0.8 | — | — | 1.40 | 4.95 | 0.25 |
| JP-05 | 0.5 | Butane-tetra-carboxylic acid | 0.214 | 1.39 | 3.32 | 1.45 |
| JP-05 | 0.8 | Butane-tetra-carboxylic acid | 0.34 | 1.38 | 5.05 | 1.81 |

The Third Embodiment

Figure 3:
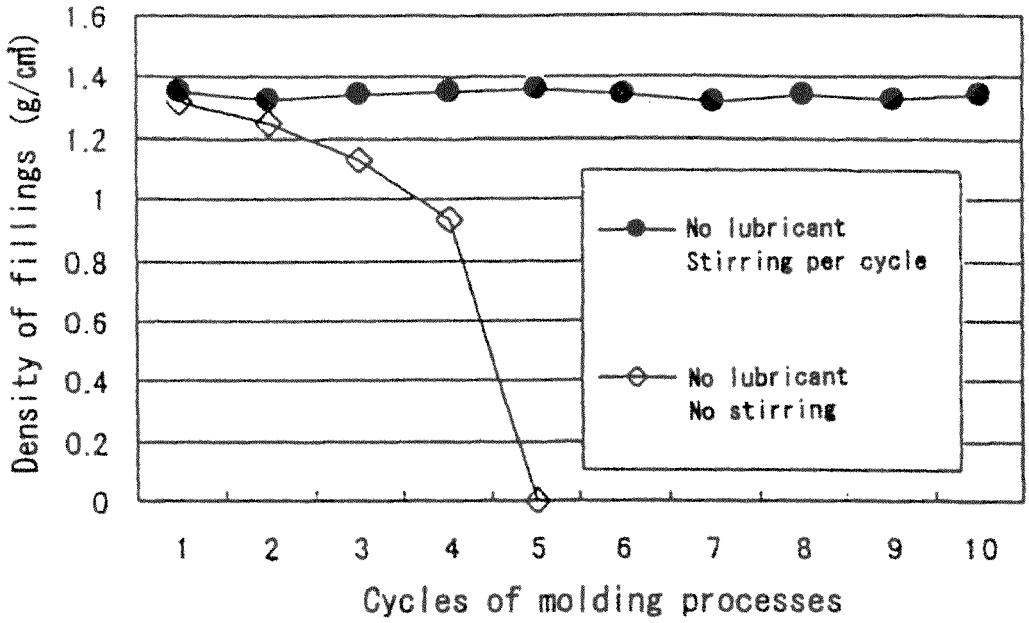
FIG. 3 shows a representation by graphs of the measured densities of mixtures of aggregate materials within a cavity, with and without a stirring effect.

A plurality of molds is molded by repeating the molding process of the second embodiment. In each molding process to mold a respective mold, the stirring blades 5 pre-stir the mixture 1 before each cycle to charge the mixture 1 into the cavity 8. A plurality of comparative molds is molded by repeating a molding process that is similar to that for the above inventive molds, except that this process uses no stirring by the stirring blades 5. FIG. 3 shows the densities measured of the fillings of the inventive molds and the comparative molds in the cavity 8. FIG. 3 indicates that each inventive mold with the pre-stirred mixture has a stable and high density, whereas each comparative mold without the pre-stirring cannot obtain a stable and high density and thus it is an undesirable mold.

The Fourth Embodiment

Figure 4:
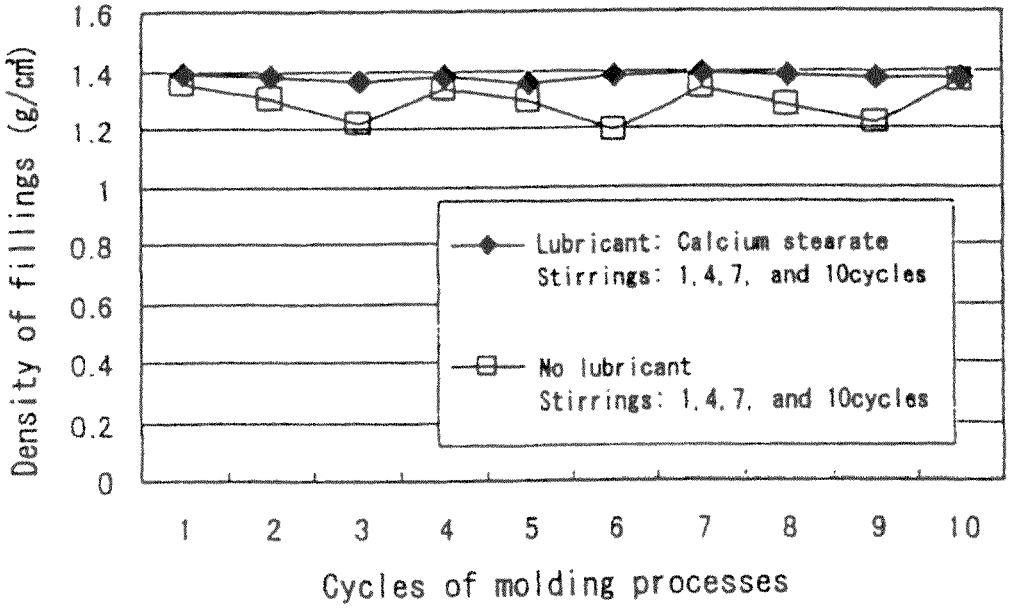
FIG. 4 shows a representation by graphs of the measured densities of mixtures of aggregate materials, with and without a lubricant, within a cavity, with one stirring effect being carried out per three cycles of charging the mixtures by blowing.

A plurality of molds is molded by repeating the molding process of the second embodiment. A plurality of additional molds is also molded by repeating the molding process of the second embodiment, but 0.01 wt % of a calcium stearate (i.e., a lubricant) is added to the mixture based on the total weight of the aggregate material. In each molding process to mold a respective mold with or without the lubricant, the stirring blades one time pre-stir the mixture 1 per three cycles to charge the quantities of the mixture 1 into the cavity 8 before the corresponding cycle. FIG. 4 shows the measured densities of the fillings of the molds and the additional molds in the cavity. FIG. 4 indicates that each additional mold with the mixture 1 containing a lubricant has a stable and high density, even if just one pre-stirring is carried out per three cycles of the charging.

The Fifth Embodiment

A dry mixture of an aggregate material is prepared in line with the second preparation (2). This dry mixture comprises 100 wt % of silica sand (flattery sand), 2.0 wt % of a starch (Amycohol KF, made by Nippon Starch Chemical Company, Japan), and 0.86 wt % of a methyl-vinyl-ether-maleic anhydride copolymer (Gantrez AN-119, made by ISP Japan Ltd). 6 wt % of water is added to and mixed with 100 wt % of the dry mixture. The dry mixture with the additional water is then further mixed, while it is frozen and cured by means of a nitro gas having temperatures lower than −30° C. In connection with FIG. 1, about 500 grams of the resultant mixture are temporarily stored in the blowing head 2, which is pre-cooled by means of a cooled-blast of a nitro gas having a temperature of about −30° C. The temporarily stored mixture is then stirred by the stirring blades 5 operating at about 60 rpm to maintain the single-grained structures in the mixture, under a condition whereby it is subjected to a cooled-blast of a nitro gas having a temperature of about −30° C. The cylinder 3 is then lowered to close the blowing head by the seal 4, which is provided at the distal end of the cylinder 3. About 100 grams of the mixture 1 are then charged by blowing compressed air supplied through the air-inlet pipe 6, which is attached to the blowing head 2, into the cavity 8, with a volume of about 70 $cm^3$, in the metal mold 7 beneath the blowing head 2. The cavity 8 is maintained at 150° C. by the internal electric-cartridge heater within the metal mold 7. The charged mixture in the cavity 8 is maintained for about 2 minutes such that the moisture within the charged mixture is then evaporated to cure the mixture. The resultant molded mold is removed from the cavity 8, which is maintained at the temperature of 150° C., of the metal mold 7. The removed mold is then placed in a temperature-controlled bath that is maintained at a temperature of 250° C., for 60 minutes, to facilitate the cross-linkage reaction. The mold is then removed from the temperature-controlled bath. The mold is then placed in a humidity-controlled bath that is maintained at a humidity of 30% to naturally cool the mold at room temperature. For a flexural investigation, specimens are made from the resultant mold.

One specimen is placed in a humidity-controlled bath that is maintained at a humidity of 30%, while another specimen is placed in a humidity-controlled bath that is maintained at a humidity of 98% for 24 hours. Table 3 shows the measured densities of the fillings and the flexural strengths of these specimens. Table 3 indicates that the specimens proved that the inventive mold has a sufficient flexural strength to be used as a mold, even it is placed in the humidity-controlled bath at a humidity of 98% for 24 hours.

TABLE 3

| Water-soluble binder (Starch) | | Cross-linker | | Density | Flexural strength (Mpa) | |
|---|---|---|---|---|---|---|
| Type | Additive quantity (wt %) | Type | Additive quantity (wt %) | of fillings ($g/cm^3$) | 30% humidity | 98% humidity for 24 hr |
| Amyco-holKF | 2.0 | Methyl-vinyl-ether-maleic anhydride copolymer | 0.86 | 1.23 | 3.85 | 2.07 |

The Sixth Embodiment

A dry mixture of an aggregate material is prepared in line with the second preparation (2). This dry mixture comprises 100 wt % of silica sand (flattery sand), 0.2 wt % of a polyvinyl alcohol (JL-05, made by Japan VAM & Poval Company), 1.0 wt % of a starch (Dextrin ND-S, made by Nippon Starch Chemical Company, Japan), and 0.86 wt % of a butane-tetra-carboxylic acid (Rikashid BT-W, made by New Japan Chemical Company).

6 wt % of water is added to and mixed with 100 wt % of the dry mixture. The dry mixture with the additional water is then further mixed, while it is frozen and cured by means of a nitro gas having temperatures lower than −30° C. In connection with FIG. 1, about 500 grams of the resultant mixture are temporarily stored in the blowing head 2, which is pre-cooled by means of a cooled-blast of a nitro gas having a temperature of about −30° C. The temporarily stored mixture is then stirred by the stirring blades 5 operating at about 60 rpm to maintain the single-grain structures in the mixture, under a condition whereby it is subject to a cooled-blast of a nitro gas having a temperature of about −30° C. The cylinder 3 is then lowered to close the blowing head by the seal 4, which is provided at the distal end of the cylinder 3. About 100 grams of the mixture 1 are then charged by blowing compressed air supplied through the air-inlet pipe 6, which is attached to the blowing head 2, into the cavity 8, with a volume of about 70 $cm^3$, in the metal mold 7 beneath the blowing head 2. The cavity 8 is maintained at 200° C. by the internal electric-cartridge heater within the metal mold 7. The charged mixture in the cavity 8 is maintained for about 2 minutes such that the moisture within the charged mixture is then evaporated to cure the mixture. The resultant molded mold is removed from the cavity 8, which is maintained at a temperature of 200° C., of the metal mold 7. The removed mold is then placed in a temperature-controlled bath that is maintained at a temperature of 250° C., for 60 minutes, to cause the cross-linkage reaction. The mold is then removed from the temperature-controlled bath. For flexural investigations, specimens are prepared from the resultant mold. One specimen is placed in a humidity-controlled bath that is maintained at a humidity of 30%, while another specimen is placed in a humidity-controlled bath that is maintained at a humidity of 98% for 24 hours. Table 3 shows the measured densities of fillings and the flexural strengths of these specimens. Table 3 indicates that the specimens proved that the inventive mold has a sufficient flexural strength to be used as a mold, even it is placed in the humidity-controlled bath at a humidity of 98% for 24 hours.

TABLE 4

| Water-soluble binder (Starch) | | Cross-linker | | Density | Flexural strength (Mpa) | |
|---|---|---|---|---|---|---|
| Type | Additive quantities (wt %) | Type | Additive quantity (wt %) | of fillings ($g/cm^3$) | 30% humidity | 98% humidity for 24 hr |
| Jl-05 (Polyvinyl alchol (Starch) | 2.0 | Butane-tetra-carboxylic acid | 0.2 | 1.40 | 3.90 | 1.76 |
| Dexrin ND-S (Starch) | 1.0 | | | | | |

The Seventh Embodiment

A dry mixture of an aggregate material is prepared in line with the second preparation (2). This dry mixture comprises 100 wt % of silica sand (flattery sand), 0.8 wt % of a polyvinyl alcohol (JL-05, made by Japan VAM & Poval Company), and 0.2 wt % of a cross-linker that is a butane-tetra-carboxylic acid (Rikashid BT-W, made by New Japan Chemical Company).

6 wt % of water is added to 100 wt % of the dry mixture. The dry mixture with the additional water is then mixed and stirred by means of a mixer (a desk-top mixer, made by Aicoh Company, Japan) operating at about 300 rpm to cause it to foam. In connection with FIG. 2, the resultant mixture is filled in the cylinder 3, which is an air cylinder whose head pressure is 0.5 MPa. About 100 grams of the mixture within the cylinder 3 are then pressure charged into the cavity 8, with a volume of about 70 $cm^3$, in the metal mold 7. The cavity 8 is maintained at 200° C. by the internal electric-cartridge heater within the metal mold 7. The charged mixture in the cavity 8 is maintained for about 2 minutes such that the moisture within the charged mixture is then evaporated to cure the mixture. The resultant molded mold is then removed from the cavity 8 of the metal mold 7. The removed mold is then placed in a temperature-controlled bath that is maintained at a temperature of 200° C., for 80 minutes to cause the cross-linkage reaction. The mold is then removed from the temperature-controlled bath. For flexural investigations, specimens are prepared from the resultant mold. One specimen is placed in a humidity-controlled bath that is maintained at a humidity of 30%, while another specimen is placed in a humidity-controlled bath that is maintained at a humidity of 98% for 24 hours. Table 4 shows the measured densities of the fillings and the flexural strengths of these specimens. Table 4 indicates that the specimens proved that the inventive mold has a sufficient flexural strength to use it as a mold, even it is placed in a humidity-controlled bath at a humidity of 98% for 24 hours.

TABLE 5

| Water-soluble binder (Polyvinyl alcohol) | | Cross-linker | | Density of fillings ($g/cm^3$) | Flexural strength (Mpa) | |
|---|---|---|---|---|---|---|
| Type | Additive quantity | Type | Additive quantity | | 30% humidity | 98% humidity for 24 hr |
| JP-05 | 0.8 | Butane-tetra-carboxylic acid | 0.2 | 1.23 | 3.59 | 1.85 |

The Eighth Embodiment

This embodiment molds core molds with two kinds of dry mixtures of aggregate materials. These mixtures differ from one another in just the kind of water-soluble binder. These mixtures of the aggregate materials are prepared in line with the second preparation (2). The one dry mixture comprises 100 wt % of silica sand (flattery sand), 0.8 wt % of a polyvinyl alcohol (JL-05, made by Japan VAM & Poval Company), and 0.2 wt % of a cross-linker that is a butane-tetra-carboxylic acid (Rikashid BT-W, made by New Japan Chemical Company). Another dry mixture comprises 100 wt % of silica sand (flattery sand), 1.0 wt % of a starch (Amycohol KF, made by Nippon Starch Chemical Company, Japan), and 0.2 wt % of a cross-linker that is a butane-tetra-carboxylic acid (Rikashid BT-W, made by New Japan Chemical Company).

5 wt % of water is added to and mixed with 100 wt % of each dry mixture. Each dry mixture with the additional water is then further mixed, while it is frozen and cured by means of a nitro gas having temperatures lower than −30° C. In connection with FIG. 1, about 500 grams of each resultant mixture is temporarily stored in the blowing head 2, which is pre-cooled by means of a cooled-blast of a nitro gas having a temperature of about −30° C. The temporarily stored mixture is then stirred by the stirring blades 5 operating at about 60 rpm to maintain the single-grain structures in the mixture, under a condition whereby it is subject to a cooled-blast of a nitro gas having a temperature of about −30° C. The cylinder 3 is then lowered to close the blowing head by the seal 4, which is provided at the distal end of the cylinder 3. About 90 grams of the mixture is then charged by blowing compressed air supplied through the air-inlet pipe 6, which is attached to the blowing head 2, into the cavity 8, with a volume of about 60 $cm^3$, in the metal mold 7 beneath the blowing head 2. The cavity 8 is maintained at 150° C. by the internal electric-cartridge heater within the metal mold 7. The charged mixture in the cavity 8 is maintained for about 2 minutes such that the moisture within the charged mixture is then evaporated to cure the mixture. The resultant molded mold is removed from the cavity 8 of the metal mold 7. The removed mold is then placed in a temperature-controlled bath that is maintained at a temperature of 220° C., for 40 minutes, in order to react the cross-linkage reaction. The mold is then removed from the temperature-controlled bath.

An ethanol-based mold wash (Three-coat MTS-720A, made by Mikawa Kousan Co., Ltd, Japan) is applied to the surfaces of each resultant mold to make a core mold for casting. For investigating the pouring characteristics, a molten metal of a cast iron (FC 250) having a temperature of 1420° C. is poured into each core mold. For the two kinds of the water-soluble binders, neither an unpleasant odor nor a cast defect (or a deformation) has been found. Further, such a core mold can be readily removed after the molten metal cools.

INDUSTRIAL AVAILABILITY

The inventive molding process with the dry mixture of the aggregate material of the present invention has beneficial effects. Both a molding step and a casting step can be carried out without the occurrences of an unpleasant odor or a poison gas caused by a pouring. After the pouring, the resultant mold can be readily removed from a cast article. In the molding step, a favorable filling property in a metal mold can be provided. The use of the cross-linkage reaction between a water-soluble binder and a cross-linker resulted in a better moisture-resistance property of the resultant mold. Molds that each have a stable and high density of a filling can be molded, even for a plurality of molding cycles. Conventional aggregate granules whose surfaces have no pre-coated binder involve a loss of time to uniformly distribute the aggregate granular material and the binder, and to uniformly distribute the cross-linker and water on the surfaces of the aggregate granules. In contrast, the mixture of the aggregate material of the present invention has the pre-coated binder applied on the surfaces of the granules such that the mixture has the single-grained structures. Therefore, the required time for preparing the mixture of the aggregate material in a molding line can be reduced. With the step by which the mixture is frozen and cured, the mixture can be readily caused to be single-grains.

The invention claimed is:

1. A method for producing a mixture of an aggregate material for molding a mold comprising the steps of:

mixing aggregate materials, one or more kind of a water-soluble binder that is soluble by water at ambient temperatures, a lubricant and water, to make a mixture;

evaporating moisture within said mixture during said mixing step such that said mixture is dried and has single-grain structures; and adding additional water to said dry mixture to form a molding material for molding a mold.

2. A method for producing a mixture of an aggregate material for molding a mold comprising the steps of:

mixing aggregate materials, one or more kind of a water-soluble binder that is soluble by water at ambient temperatures, a lubricant and water, to make a mixture;

evaporating moisture within said mixture, during said mixing step such that said mixture is dried and has single-grain structures;

adding additional water to said dry mixture;

stirring said dry mixture with said additional water to cause it to foam in order to form a molding material for molding a mold.

3. The method of claim 1 or 2, wherein said water-soluble binder is a polyvinyl alcohol having a degree of hydrolysis from 80 mol % to 95 mol % or a derivative thereof or an α starch or dextrin or a derivative thereof or both.

4. The method of claim 1 or 2, wherein said mixture contains from 0.1 wt % to 5.0 wt % of said water-soluble binder based on the total weight of said aggregate material.

5. A method for producing a mixture of an aggregate material for molding a mold comprising the steps of:

mixing an aggregate granular material, a water-soluble binder that is soluble by water at an ambient temperature, a cross-linker that is capable of cross-linking with said water-soluble binder, a lubricant and water;

evaporating moisture within said mixture during said mixing step to prevent the cross-linking reaction between said water-soluble binder and said cross-linker such that said mixture is dried and has single-grain structures;

adding additional water to said dry mixture; and freezing said dry mixture with the additional water to maintain said single-grain structures in said mixture in order to form a molding material for molding a mold.

6. A method for producing a mixture of an aggregate material for molding a mold comprising the steps of:

mixing an aggregate granular material, a water-soluble binder that is soluble by water at an ambient temperature, a cross-linker that is capable of cross-linking with said water-soluble binder, a lubricant and water;

evaporating moisture within said mixture during said mixing step to prevent the cross-linking reaction between said water-soluble binder and said cross-linker such that said mixture is dried and has single-grain structures;

adding additional water to said dry mixture; and stirring said dry mixture with said additional water to cause it to foam in order to form a molding material for molding a mold.

7. The method of claim 5 or 6, wherein said water-soluble binder is a polyvinyl alcohol having a degree of hydrolysis from 80 mol % to 95 mol % or a derivative thereof or an α starch or dextrin or a derivative thereof or both.

8. The method of claim 5 or 6, wherein said mixture contains from 0.1 wt % to 5.0 wt % of said water-soluble binder based on the total weight of said aggregate granular material.

9. The method of claim 5 or 6, wherein said water-soluble binder is a carboxylic compound.

10. The method of claim 9, wherein said carboxylic compound is selected from the group consisting of an oxalic acid, a maleic acid, a succinic acid, a citric acid, a butane-tetracarboxylic acid, a methyl vinyl ether-maleic anhydride copolymer, and an isobutylene-maleic anhydride copolymer.

11. A method for producing a mixture of an aggregate material for molding a mold as recited in claim 1, 2, 5 or 6, wherein said lubricant is selected from the group consisting of liquid paraffin, calcium stearate, zinc stearate and magnesium stearate.

12. A method for producing a mixture of an aggregate material for molding a mold as recited in claim 11, wherein the lubricant is calcium stearate in an amount of from 0.01 to 0.1 weight % based on the total weight of said aggregate material.

* * * * *